US005176344A

United States Patent [19]

Eberhard

[11] Patent Number: 5,176,344

[45] Date of Patent: Jan. 5, 1993

[54] NET GAME POLE SUPPORT

[75] Inventor: Stephen Eberhard, 4785 Saddle Club La., Santa Rosa, Calif. 95409

[73] Assignee: Stephen E. Eberhard, Santa Rosa, Calif.

[21] Appl. No.: 664,218

[22] Filed: Mar. 4, 1991

Related U.S. Application Data

[63] Continuation of Ser. No. 441,389, Nov. 27, 1989, abandoned.

[51] Int. Cl.[5] ..... A63B 69/00

[52] U.S. Cl. ..... 248/156; 248/545; 248/530; 273/29 BB

[58] Field of Search ..... 248/156, 545, 530; 52/156, 155, 157, 158, 165; 273/29 B, 29 BB, 411

[56] References Cited

U.S. PATENT DOCUMENTS

| | | | |
|---|---|---|---|
| 1,362,238 | 12/1970 | Dietz | 52/165 X |
| 4,046,214 | 8/1977 | Frye | 273/29 BB X |
| 4,093,224 | 6/1978 | Hale | 273/29 BB X |
| 4,913,428 | 4/1990 | Nauman et al. | 273/411 X |

FOREIGN PATENT DOCUMENTS

| | | | |
|---|---|---|---|
| 2635429 | 8/1976 | Fed. Rep. of Germany | 273/411 |
| 2550238 | 8/1978 | Fed. Rep. of Germany | 273/29 BB |
| 182091 | 4/1936 | Switzerland | 273/29 BB |
| 1395538 | 5/1988 | U.S.S.R. | 273/29 BB |
| 195500 | 4/1973 | United Kingdom | 273/29 BB |
| 207343 | 11/1973 | United Kingdom | 273/29 BB |

*Primary Examiner*—Alvin C. Chin-Shue

[57] ABSTRACT

A net game comprising of a pair of poles that are tightened across using a rope or cable in support of a net for net games. Said pole members are tubular in shape and are joined with ground anchor members that are of similar shape so as to slip-fit one over the other. Ground anchor members are rigidly placed partially within the earth for attachment and support of pole members. This standard is self-supporting and is suitable for a variety of net game sports.

4 Claims, 1 Drawing Sheet

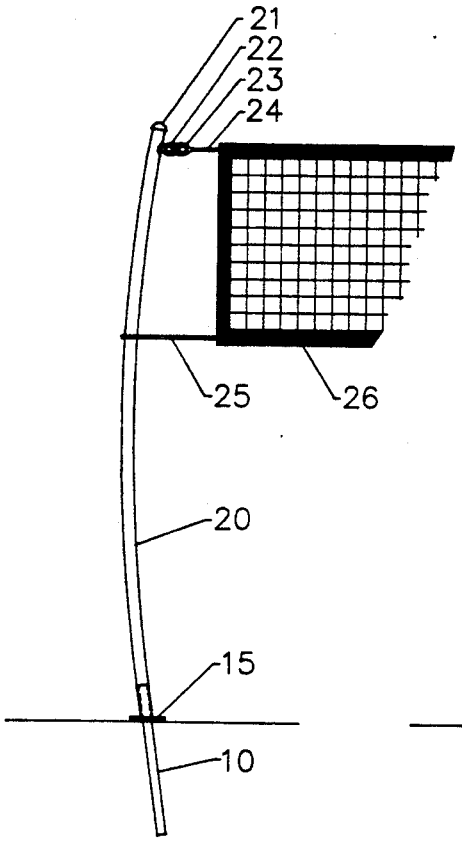
FIG. 1
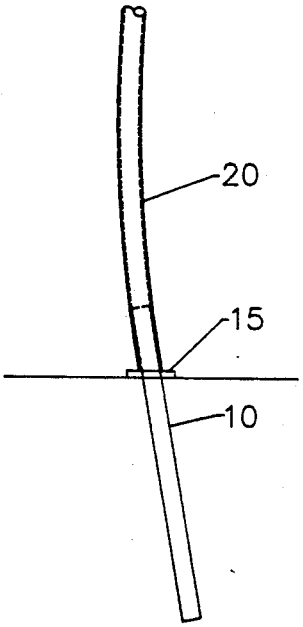
FIG. 2
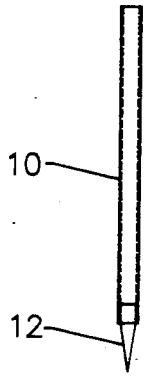
FIG. 4
FIG. 3
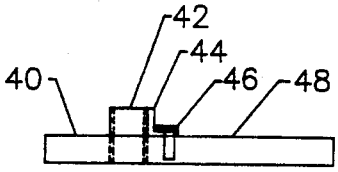
FIG. 5

NET GAME POLE SUPPORT

The present application is a continuation in part of U.S. application Ser. No. 07 441,389. Retain filing date of Nov. 27, 1989, now abandoned.

BACKGROUND OF THE INVENTION

This invention relates to support structures and hardware related thereto, a portable and removable anchor pole support for a variety of net games. More specifically a net game pole support that has eliminated the use of hazardous guy wire supports.

1. Description of the Prior Art

Poles and standards for supporting portable game nets are well known. The more universal standards, such as those used for court games, generally represent a compromise design which has several undesirable features. Common detrimental aspects of these systems are the guy wires necessary to support the pole. Guy wires are not only awkward but require considerable time to install, often using several stakes that are driven into the ground and affixed to the pole by wires, ropes or the like. The guy wires or ropes and stakes create a dangerous situation to the players of the game who may accidentally run into or trip over them causing personal injury. Other common standards are designed to be placed into or otherwise attached to permanent concrete blocks. The poles of such systems may be removed with some conventional sets, but the support block stays in the ground. Thus, they are not portable.

2. Principal Object

A principal object of this invention (net game pole support) is to provide a support pole of simple structure that is also portable, i.e., one that can be set up, utilized, and then removed.

A further object of this invention is to avoid the necessity of guy wires to support a game net pole.

A further object of this invention is to provide a support pole which enables rapid installation in a variety of soils including sand.

A further object of this invention is to supply a support pole of simple structure that is very basic and simple to install such that anyone may have the ability to understand and use it.

A further object of this invention is that it is not limited to being used for a temporary structure, and can be left in the ground and utilized for some years, as, for example, a back yard game net (optional).

SUMMARY OF THE INVENTION

The ground anchor pole support of this invention provides a removable, self-supporting standard for a game net. A pipe, bar or length of tubing is driven or placed into the ground using a sledgehammer or the like, thereby forming a ground anchor member. A pole member of comparable shape is placed over the anchor member to ground level. This standard is self-supporting, and suitable for supporting a game net for volleyball, soccer, tennis, badminton, etc. by tightening a net between two such poles. The concept is to attach a support structure to the earth for use.

Said ground anchor pole support is portable and removable. It can easily be set up, utilized, and then the entire unit including said ground anchor member can be removed. Tapping on the anchor member from different sides will loosen it so it can be easily pulled out of the ground and taken away to be used elsewhere.

The preferred embodiment of the invention's said anchor portion comprises of rigid material being of pipe, bar, or tubing. And the adjoining structure comprises a rigid metal pole member which is sized to slip over said anchor member that is driven into the ground. A washer of comparable size may be slipped over said anchor member to serve as a stop at ground level when the pole member is placed.

The ground anchor members of this invention, described within this application "net game pole support", are an important aspect in consideration over prior art. Said anchor members are designed to withstand significant lateral forces. For example a game net for volleyball is fastened to said pole members and are tightened between the top of said pole members that are spaced approximately 34 feet apart and are approximately 8 feet above the ground. It is an important aspect that the net top be very taut with minimal sag. With the said pole members being of a height of eight feet above the ground, pulling the net tight creates a great leverage and stress throughout the length of the pole and where the pole member meets the ground (supported by said ground anchor member.

When said net is tightened, it is pulled tight by hand exerting approximately 100 pounds pull. This allows only about 1" of sag across a 34-foot span. The most intricate part and stabilizer of said invention is the said ground anchor.

The actual length of said ground anchor member is approximately 30 inches. The distance that this anchor member is driven into the earth will vary on the density or looseness of the soil. It is of small diameter that it may be driven into the ground with minimal effort. It is hollow (rather than using solid bar) for reducing the weight factor making it more portable.

This invention teaches that in place of guy supports to counteract the force of tightening a game net across from pole member to pole member, that the said anchor members are set at an angle out away from each other. Thus the said pole members that are placed over said anchor members are angled out away from each other. When the top rope or cable of a game net is tightened between said pole members there is a bow created to where the top of said pole members flex bringing them in line approxmately to the bottom of said pole members. A counteracting force pulling away from or in the opposite direction of the top force that is pulling inward. This technique described by applicant is unique and unobvious to those of the industry of portable net game standards in tightening a game net across a prescribed distance. The counter forces implemented by said pole members and said anchor members creates a bow lending a constant force pulling outward, when a game net is tightened between said pole members. This invention is a respectable improvement in a net game support to the atheletes who participate in such sports. This apparatus has been designed and developed to support a game net in a variety of sports that require a net (volleyball, tennis, soccer, badminton, etc.) whereas a pair of pole members flex in supporting a net, where net is preferred to be tight across from pole to pole. This apparatus has been developed to be self-supporting and not requiring guy supports to obtain and maintain a tight net between poles.

The primary design of said ground anchor member pole support of this invention is to achieve a practical way of setting up a net system that is effective, strong and superior in obtaining a tight net across, thus providing a safer game by eliminating guy supports. This pole member support is "self-supporting" even in sand. This invention will enhance and advance net game sports while creating a safer game environment.

Setting up conventional type (prior art) volleyball systems on the sand requires a great deal of digging to bury sand anchor member (a disk like member) for guy wire supports. This type of guy wire support takes time to install and is inferior to said invention when tightening the net while setting up for play. Guy wire tightening becomes inferior to this invention (net game pole support).

Useful and practical accessories for installation of said ground anchor members include an alignment plate (FIG. 5) that is used to aid in keeping said anchor member in line vertically and at a prescribe angle as it is driven into the ground. The alignment plate is then removed by sliding it up over said anchor member before placement of the said washer and said pole member. The alignment plate is comprised of a pipe comparable to the diameter of said pole member to be set at an angle, and is fixed to a base plate for stability.

In addition, a protector cap (FIG. 4) prevents said anchor member from being damaged as it is driven or hammered into the earth. The said cap is placed on top of said anchor member before it is driven into the ground. This too is removed before placement of said pole member over said anchor member.

BRIEF DESCRIPTION OF THE DRAWINGS

In order that all the structural features for attaining the object of this invention may be readily understood, detailed reference is made to the drawings herein:

FIG. 1 is an elevation view of an embodiment of a ground anchor net game pole support of this invention, illustrating a pole member supporting a typical game net for volleyball;

FIG. 2 is an enlarged side view of the ground anchor pole support of FIG. 1, illustrating the relative arrangement of the ground anchor member, pole member, and washer;

FIG. 3 is a side elevation view of a modified ground anchor member including a solid portion or point;

FIG. 4 is a side elevation view of a protector cap for the ground anchor described of this invention; and FIG. 5 is a side elevation view of an alignment plate for the groudn anchor described of this invention.

DETAILED DESCRIPTION OF A PREFERRED EMBODIMENT

FIG. 1 is an elevation view of an embodiment of a ground anchor pole support of this invention, illustrating a pole member supporting a typical volleyball game net. Ground anchor member 10 is placed or driven approximately two-thirds into the ground, depending on the looseness of the soil. Washer 15 is place over the anchor member 10, and serves as a base pad for pole member 20, which is easily placed over the anchor member and is brought substantially even to the ground level. Thus, the washer and pole member each have an inside diameter slightly greater than the outside diameter of said anchor member, and fit over said anchor member. This standard is self-supporting and requires no additional supports or guys.

Preferred material for said ground anchor member 10 is one inch schedule 80 pipe or tubing, approximately thirty inches long; for washer 15, a flat 1¼" carbon steel washer; and for said pole member 20, aluminum 1¼" pipe approximately eight feet long. A typical application for use as a volleyball net standard would include pipe cap 21, eye bolt 22, hook 23, net rope or cable 25, stretch cord 25, and net 26. Two poles spaced at a proper distance will support a game net for a variety of sports. When tightening a game net across a prescribed distance the poles will bow, thus said anchor members should be angled out away from each other (as described infra).

FIG. 2 is an enlarged side view of said ground anchor pole support of FIG. 1, illustrating the relative arrangement of said ground anchor member 10, pole member 20, and washer 15.

FIG. 3 is a side elevation view of a modified ground anchor member 10 including a point portion 12 on its bottom end. This design enables easier driving of the anchor member into rocky soil, with point 12 (made from solid bar) welded to the anchor member.

FIG. 4 is a side elevation view of a protector cap 30 for said ground anchor pole support of this invention. This accessary assures the ability for repeated use of said ground anchor member. This protector cap is placed on top of the anchor member to prevent damaging the top end of said anchor member when driving it into the ground. Cylinder 32 is made of a short section of pipe comparable in diameter to said pole member to be placed above ground in order to slip-fit over said anchor member. The inside diameter is slightly larger than the outside diameter of said anchor member. Cap 34 is of metal approximately ⅜" thick and is welded to one end of the cylinder. This protector cap can be placed on said anchor member and hit with a sledgehammer without bouncing off the said anchor member it protects.

FIG. 5 is a side elevation view of said alignment plate 40 for said ground anchor pole support of this invention. For game net supports, the alignment plate should be preset with portion No. 42 angled out a few degrees, depending on the desired height of the game net. The alignment plate includes a short section of pipe 42, again comparable in diameter to said pole member, attached to an angle iron 44 or similar component. Lag screw 46 secures the pipe and angle iron to a base plate 48, which may surround pipe 42. Thus the angle and alignment of pipe 42 relative to base 48 can be changed by appropriate adjustment.

Obvious improvements of the preferred embodiment for net sports include a standard fabricated from round or square tubing in carbon steel, galvanized carbon steel, wood, bamboo, fiberglass, or various alloys of metal to include aluminum, using the same concept of slip fitting comparable sizes one over the other, or one inside of the one that is driven into the ground.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims. These claims are all submitted to be patentable for (1) they recite novel structure and distinguish physically over prior art (Sec. 102), and (2) the physical distinctions affect new and unexpected results, thereby indicating that the physical distinctions are obvious under Sec. 103.

What is claimed as invention is:

1. In a game apparatus having a net to be mounted above a playing surface, said net having opposite ends, the improvement comprising:

a pair of substantially rectilinear flexible support poles each having a lower end and an upper end;

a pair of laterally spaced substantially rectilinear rigid anchor members extending at a preselected angle outwardly away from each other through the playing surface to have a lower portion thereof disposed below said playing surface and an upper portion disposed thereof above said playing surface, said lower ends of said support poles being removably fitted one each over said upper portion of said anchor members, whereby said lower ends of said support poles extend at said preselected angle outwardly away from each other; and means for securing the opposite ends of the net one each to said upper ends of said support poles, including means for tightening the net between said upper ends of the support poles suitable to draw said upper ends of said support poles into approximate vertical alignment with said bottom ends of said support poles, and with said anchor members and lower ends of the support poles retained at said preselected angle.

2. The game apparatus of claim 1 wherein said anchor members are tubular.

3. The game apparatus of claim 1 wherein said lower portions of said anchor members are pointed.

4. The game apparatus of claim 1 further comprising washer members disposed loosely one each about said upper portions of said anchor members on said playing surface for resisting movement of said lower ends of said support poles downwardly through said playing surface.

* * * * *